US005309719A

United States Patent [19]

Agrawal et al.

[11] Patent Number: 5,309,719

[45] Date of Patent: May 10, 1994

[54] PROCESS TO PRODUCE A KRYPTON/XENON ENRICHED STREAM FROM A CRYOGENIC NITROGEN GENERATOR

[75] Inventors: Rakesh Agrawal, Emmaus; Steven L. Feldman, Macungie, both of Pa.

[73] Assignee: Air Products and Chemicals, Inc., Allentown, Pa.

[21] Appl. No.: 17,555

[22] Filed: Feb. 16, 1993

[51] Int. Cl.[5] ..... F25J 3/04

[52] U.S. Cl. ..... 62/22; 62/24

[58] Field of Search ..... 62/22, 24

[56] References Cited

U.S. PATENT DOCUMENTS

| | | | |
|---|---|---|---|
| 3,751,934 | 8/1973 | Frischbler | 62/41 |
| 4,568,528 | 2/1986 | Cheung | 423/262 |
| 4,574,006 | 3/1986 | Cheung | 62/22 |
| 4,805,412 | 2/1989 | Colley et al. | 62/22 |
| 4,818,262 | 4/1989 | Brugerolle | 62/22 |
| 4,872,893 | 10/1989 | Agrawal et al. | 62/11 |
| 5,063,746 | 11/1991 | Agrawal et al. | 62/22 |
| 5,067,976 | 11/1991 | Agrawal et al. | 62/22 |
| 5,122,173 | 6/1992 | Agrawal et al. | 62/22 |

FOREIGN PATENT DOCUMENTS 1215377 12/1970 United Kingdom .

*Primary Examiner*—Ronald C. Capossela

*Attorney, Agent, or Firm*—Robert J. Wolff; William F. Marsh; James C. Simmons

[57] ABSTRACT

A process is set forth for producing a krypton/xenon enriched stream from a cryogenic nitrogen generator. Distillation of the oxygen product stream at the top of the low pressure column is suggested in order to concentrate krypton and xenon while rejecting the majority of methane in the oxygen product stream.

4 Claims, 1 Drawing Sheet

PROCESS TO PRODUCE A KRYPTON/XENON ENRICHED STREAM FROM A CRYOGENIC NITROGEN GENERATOR

TECHNICAL FIELD

The present invention relates to a process for the cryogenic distillation of air into its constituent components, especially nitrogen, wherein a stream enriched in krypton and xenon is produced directly from the main air distillation column.

BACKGROUND OF THE INVENTION

Krypton and xenon are present in air as trace components, 1.14 parts per million by volume (1.14 vppm) and 0.086 vppm, respectively, and can be produced in pure form from the cryogenic distillation of air. Both of these elements are less volatile (i.e., have a higher boiling temperature) than oxygen and therefore concentrate in the liquid oxygen sump of a conventional double column air separation unit. Other impurities which are also less volatile than oxygen (most notably methane) also concentrate in the liquid oxygen sump along with krypton and xenon.

Unfortunately, process streams containing oxygen, methane, krypton and xenon present a safety problem due to the combined presence of methane and oxygen. Methane and oxygen form flammable mixtures with a lower flammability limit of 50-. methane in oxygen. In order to operate safely, the methane concentration in an oxygen stream must not be allowed to reach the lower flammability limit and, in practice, a maximum allowable methane concentration is set that is a fraction of the lower flammability limit. This maximum constraint effectively limits the concentration of the krypton and xenon that is attainable in the sump as any further concentration of these products would also result in a methane concentration exceeding the maximum allowed.

The conventional technology accepts this limitation on the concentration of the krypton and xenon that is attainable in the liquid oxygen boiling in the sump and removes methane in a separate distillation column (typically referred to in the art as the raw krypton/xenon column) so that further concentrating of the krypton and xenon in the liquid oxygen stream (usually via distillation) can safely be performed. See for example the processes taught in the following U.S. Pat. Nos.: 3,751,934; 4,568,528; 5,063,746; 5,067,976; and 5,122,173.

The present invention's method to produce a stream enriched in krypton and xenon is specifically applicable for those cryogenic air separation processes which are designed for nitrogen production (i.e. cryogenic nitrogen generators). Such a process is taught in British Patent 1,215,377. It is an object of the present invention to modify the conventional nitrogen generator in order to remove the methane which is conventionally removed in a raw krypton/xenon column, thereby saving the expense of a separate distillation column and the associated reboiler/condenser.

SUMMARY OF THE INVENTION

The present invention is a method for producing a stream enriched in krypton and xenon. The method is applicable to a process for the cryogenic distillation of an air feed using a multiple column distillation system comprising a high pressure column and a low pressure column wherein:

(a) at least a portion of the air feed is fed to the high pressure column in which the air feed is rectified into a high pressure nitrogen overhead and a high pressure crude liquid oxygen bottoms;

(b) at least a portion of the high pressure crude liquid oxygen bottoms is fed to the low pressure column in which the high pressure crude liquid oxygen bottoms is rectified into a low pressure nitrogen overhead and a low pressure liquid oxygen bottoms;

(c) a first portion of the low pressure liquid oxygen bottoms is boiled in a first sump located in the bottom of the low pressure column; and (d) a second portion of the low pressure liquid oxygen bottoms is boiled in a second sump located above the low pressure column by indirect heat exchange against condensing low pressure nitrogen overhead.

The method for producing the stream enriched in krypton and xenon in the above process comprises:

(i) distilling the vapor generated from said boiling of the second portion of the low pressure liquid oxygen bottoms in step (d) in a third distillation column having the second sump located in its bottom wherein a third portion of the low pressure liquid oxygen bottoms is used to provide reflux for the third distillation column; and (ii) withdrawing the krypton/xenon enriched stream from the bottom of the second sump.

DETAILED DESCRIPTION OF THE INVENTION

Figure 1:
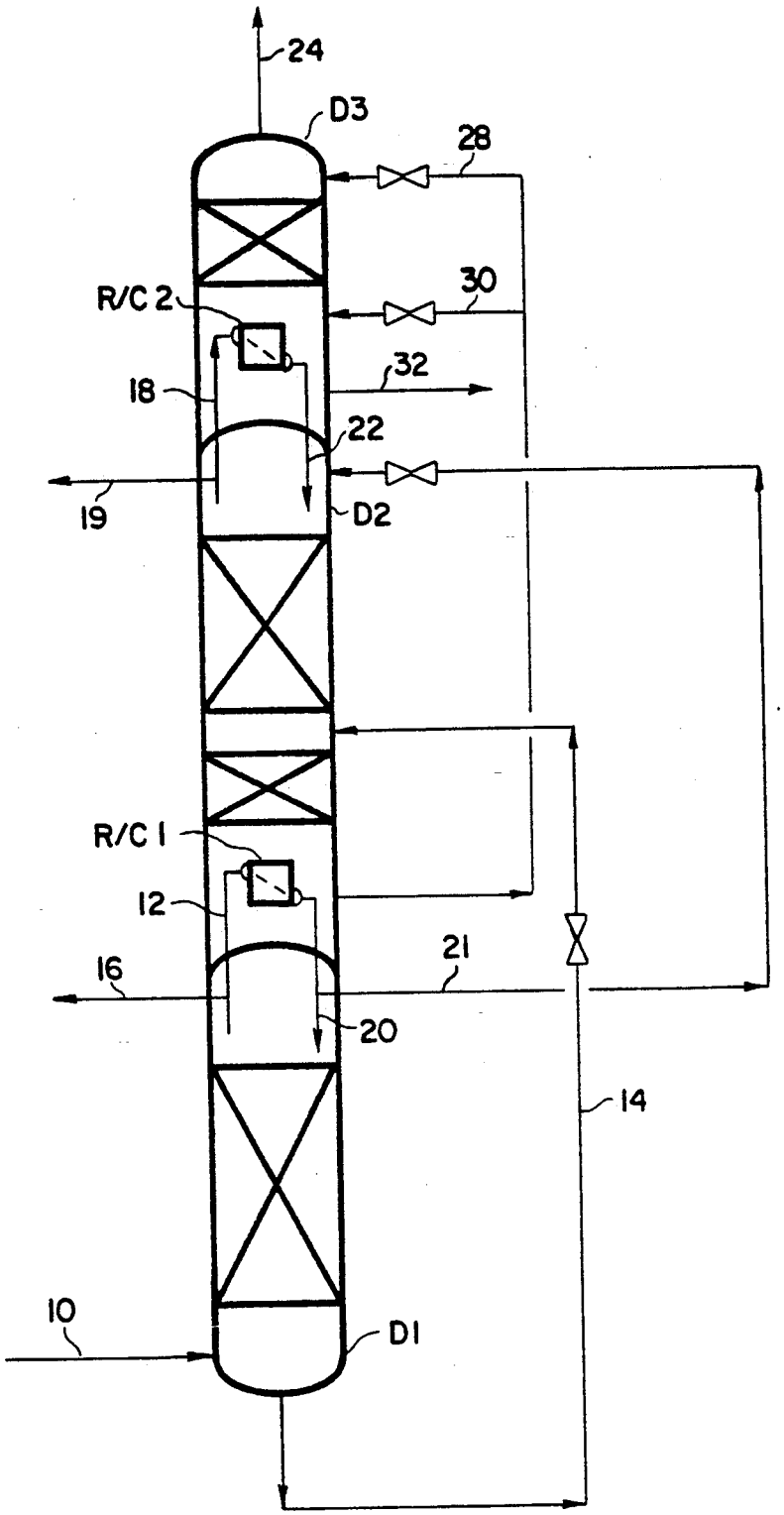
FIG. 1 is schematic diagram illustrating one embodiment of the present invention.

The process of the present invention will be described in detail with reference to the drawing.

Referring now to FIG. 1, an air feed 10 which has been compressed, cleaned of impurities which will freeze out at cryogenic temperatures and cooled down to cryogenic temperatures is introduced into a multiple column distillation system comprising high pressure column D1, a low pressure column D2 and a lower pressure column D3. The air feed is more specifically fed to the high pressure column in which the air feed is rectified into a high pressure nitrogen overhead (a portion of which is removed as a nitrogen product in stream 16) and a high pressure crude liquid oxygen bottoms 14. At least a portion of the high pressure crude liquid oxygen bottoms is fed to the low pressure column in which the high pressure crude liquid oxygen bottoms is rectified into a low pressure nitrogen overhead (a portion of which is removed as a high purity nitrogen product in stream 19) and a low pressure liquid oxygen bottoms which collects in the sump located at the bottom of the low pressure column. A first portion of the low pressure liquid oxygen bottoms is boiled in a reboiler/condenser R/C 1 located in the low pressure column's sump by indirect heat exchange against condensing high pressure nitrogen overhead from stream 12. A second portion of the low pressure liquid oxygen bottoms (i.e. a portion of the unboiled liquid in the low pressure column's sump) is withdrawn as stream 30 and is boiled in a second reboiler/condenser R/C 2 located in the third distillation column's sump by indirect heat exchange against condensing low pressure nitrogen overhead from stream 18. Alternatively, stream 30 could be introduced into column D3 at least one equilibrium stage above D3's sump. (As used herein, an equilibrium stage is defined as a vapor-liquid contacting stage wherein the vapor and liquid leaving the stage are in mass transfer equilibrium). At least a portion of the condensed nitrogen is used to provide reflux for the columns D1 and D2 via streams 20, 21 and 22 while a third portion of the low pressure liquid oxygen bottoms is used to provide reflux for column D3 via stream 28. The krypton/xenon enriched oxygen stream 32 is withdrawn from D3's sump while the methane is rejected in the oxygen-enriched vapor stream 24.

It is worth pointing out that in a typical nitrogen generator such as the one described in British Patent 1,215,377, no equilibrium stages are used above reboiler/condenser R/C 2 and there is no stream corresponding to stream 28 in FIG. 1. Contrast this to the current invention wherein a suitable number of equilibrium stages are added above reboiler/condenser R/C 2 and wherein stream 28 is used to reflux the top of the newly formed distillation column D3.

The key to the present invention as embodied in FIG. 1 is the distillation of the oxygen-enriched vapor stream rising in the lower pressure column D3 wherein reflux for this distillation is provided via stream 28 such that the majority of the methane contained in the air feed can be rejected in the oxygen-enriched vapor stream 24. Preferably, the reflux is adjusted such that the ratio of liquid to vapor in column D3 is less than 1.0 and more preferably is between 0.05 and 0.40. In this ratio range, the descending reflux is sufficient to strip most of the krypton and nearly all of the xenon from the ascending vapor but is insufficient to strip the majority of the methane from the ascending vapor. (The boiling points of methane, krypton and xenon are −161° C., −152° C. and −109° C. respectively). This allows the methane to be removed as part of the oxygen-enriched vapor stream which is withdrawn as stream 24 in FIG. 1. The lower range of the ratio reflects the fact that at some point, there will be insufficient reflux to wash the krypton from the ascending vapor as well. The upper range of the ratio reflects the fact that at some point, there will be too much reflux to allow the methane to escape with the ascending vapor. The optimum value of the ratio will depend on just how much krypton one can tolerate to lose in the oxygen-enriched vapor stream which is withdrawn as stream 24 in FIG. 1.

Clearly the present invention of adding the required number of equilibrium stages above the reboiler/condenser from where the final boiled oxygen-enriched gaseous product stream in withdrawn and also splitting the oxygen-enriched liquid feed to this reboiler/condenser into two streams such that one portion is fed to the top of the added equilibrium stages and the remaining portion is directly fed to the this reboiler/condenser is applicable to single column nitrogen generators such as taught in U.S. Pat. No. 4,872,893.

The present invention has been described with reference to a specific embodiment thereof. This embodiment should not be seen as a limitation of the scope of the present invention; the scope of such being ascertained by the following claims.

We claim:

1. In a process for the cryogenic distillation of an air feed using a multiple column distillation system comprising a high pressure column and a low pressure column wherein:

(a) at least a portion of the air feed is fed to the high pressure column in which the air feed is rectified into a high pressure nitrogen overhead and a high pressure crude liquid oxygen bottoms;

(b) at least a portion of the high pressure crude liquid oxygen bottoms is fed to the low pressure column in which the high pressure crude liquid oxygen bottoms is rectified into a low pressure nitrogen overhead and a low pressure liquid oxygen bottoms;

(c) a first portion of the low pressure liquid oxygen bottoms is boiled in a first sump located in the bottom of the low pressure column; and (d) a second portion of the low pressure liquid oxygen bottoms is boiled in a second sump located above the low pressure column by indirect heat exchange against condensing low pressure nitrogen overhead;

a method for producing a stream enriched in krypton and xenon comprising:

(i) distilling the vapor generated from said boiling of the second portion of the low pressure liquid oxygen bottoms in step (d) in a third distillation column having the second sump located in its bottom wherein a third portion of the low pressure liquid oxygen bottoms is used to provide reflux for the third distillation column; and (ii) withdrawing the krypton/xenon enriched stream from the bottom of the second sump.

2. The process of claim 1 wherein the amount of the third portion, of the low pressure liquid oxygen bottoms which is used to provide reflux for the third distillation column is an amount sufficient to have a ratio of liquid to vapor in the third distillation column between 0.05 and 0.4.

3. The process of claim 1 wherein the second portion of the low pressure liquid oxygen boiled in the second sump in step (d) is introduced into the third distillation column at least one equilibrium stage above the second sump.

4. The process of claim 1 wherein the first portion of the low pressure liquid oxygen which is boiled in the sump in step (c) is boiled by indirect heat exchange against condensing high pressure nitrogen overhead and wherein at least a portion of the condensed high pressure nitrogen overhead is used to provide reflux for the distillation system.

* * * * *